US007650826B2

(12) United States Patent
Son et al.

(10) Patent No.: US 7,650,826 B2
(45) Date of Patent: Jan. 26, 2010

(54) AUTOMATIC SHOOTING MECHANISM AND ROBOT HAVING THE SAME

(75) Inventors: Tae-jin Son, Changwon-si (KR); Jun-yeoul Ko, Changwon-si (KR)

(73) Assignee: Samsung Techwin Co., Ltd., Changwon (KR)

( * ) Notice: Subject to any disclaimer, the term of this patent is extended or adjusted under 35 U.S.C. 154(b) by 109 days.

(21) Appl. No.: 11/711,422

(22) Filed: Feb. 27, 2007

(65) Prior Publication Data

US 2007/0204745 A1 Sep. 6, 2007

(30) Foreign Application Priority Data

Mar. 3, 2006 (KR) ..... 10-2006-0020410

(51) Int. Cl.
*F41G 3/00* (2006.01)
*F41G 5/06* (2006.01)
*F41A 19/00* (2006.01)

(52) U.S. Cl. ..... 89/27.3; 89/41.01; 89/41.05; 42/69.01; 42/70.01

(58) Field of Classification Search ..... 89/27.3, 89/41.01–41.15, 125; 42/69.01, 70.01
See application file for complete search history.

(56) References Cited

U.S. PATENT DOCUMENTS 3,711,638 A * 1/1973 Davies ..... 348/143
4,205,589 A * 6/1980 Engler et al. ..... 89/41.07
4,621,562 A * 11/1986 Carr et al. ..... 89/41.05
4,718,187 A * 1/1988 Blake ..... 42/84
4,932,831 A * 6/1990 White et al. ..... 414/732
5,022,812 A * 6/1991 Coughlan et al. ..... 414/729
5,168,114 A * 12/1992 Enget ..... 42/70.01
5,379,676 A 1/1995 Profeta et al.
5,949,015 A * 9/1999 Smith et al. ..... 89/41.05
5,966,859 A * 10/1999 Samuels ..... 42/70.11
6,009,791 A * 1/2000 Medlin ..... 89/38
6,113,343 A * 9/2000 Goldenberg et al. ..... 414/729
6,351,906 B1 * 3/2002 Honig et al. ..... 42/70.11
6,860,206 B1 * 3/2005 Rudakevych et al. ..... 102/206
6,951,071 B1 * 10/2005 Acosta et al. ..... 42/69.01
7,143,696 B2 * 12/2006 Rudakevych et al. ..... 102/215
7,356,958 B2 * 4/2008 Weir ..... 42/69.01

(Continued)

*Primary Examiner*—Bret Hayes
*Assistant Examiner*—Michael D David
(74) *Attorney, Agent, or Firm*—Drinker Biddle & Reath LLP

(57) ABSTRACT

An automatic shooting mechanism capable of remote switching and unmanned switching between a safety mode and a shooting mode, and remote shooting and unmanned shooting. Also provided is a sentry robot employing the automatic shooting mechanism and capable of performing wide and narrow monitoring and sentry duties in short and long ranges, and automatically shooting at a target. The automatic shooting mechanism comprises a safety unit including a safety solenoid and an elastic member to move a safety pin of a gun between a safety mode position and a shooting mode position, and a return unit for applying force to the safety pin of the gun to move the safety pin to the safety mode position. The automatic shooting mechanism further comprises a shooting unit including a shooting solenoid to move a connecting link back and forth, and a trigger push member having one end contacting a trigger of the gun and the other end contacting the shooting solenoid, and coupled at a middle portion of the shooting unit to be capable of pivoting to pull the trigger as desired.

21 Claims, 7 Drawing Sheets

U.S. PATENT DOCUMENTS

2003/0163941 A1* 9/2003 Herzog ..... 42/70.07
2003/0163942 A1* 9/2003 Herzog et al. ..... 42/70.07
2007/0119326 A1* 5/2007 Rudakevych et al. ..... 102/206
2007/0209501 A1* 9/2007 Ko ..... 89/40.01
2008/0121097 A1* 5/2008 Rudakevych et al. ..... 89/28.05

* cited by examiner

AUTOMATIC SHOOTING MECHANISM AND ROBOT HAVING THE SAME

CROSS-REFERENCE TO RELATED PATENT APPLICATIONS

This application claims the benefit of Korean Patent Application No. 10-2006-0020410, filed on Mar. 3, 2006, in the Korean Intellectual Property Office, the disclosure of which is incorporated herein in its entirety by reference.

BACKGROUND OF THE INVENTION

1. Field of the Invention

The present invention relates to an automatic shooting mechanism and a robot having the same. More particularly, the present invention relates to an automatic shooting mechanism capable of remote switching and unmanned switching between a safety mode and a shooting mode, and remote shooting and unmanned shooting, and a sentry robot employing the automatic shooting mechanism and being capable of performing wide and narrow monitoring and sentry duties in short and long ranges and automatically shooting at a target.

2. Description of the Related Art

Intelligent robot technology is one of the next generation new technologies which will lead the 21$^{st}$ century's industrial and military science technologies with the development of artificial intelligence (AI). For example, a monitoring and sentry system can be a sophisticated system employing a variety of technologies such as ultra-low brightness camera technology, image recognition technology, image processing and storing technology, voice recognition technology, servo technology, image tracking technology, and system control technology.

As the security industry grows rapidly, demands for the use of intelligent monitoring and sentry robot systems in important national facilities such as airports, harbors, and nuclear power plants have increased accordingly. Such systems can be used in military settings to provide efficient sentries during peace time, and to improve the security of soldiers during war time by performing 3D (dangerous, dirty, dull) duties that are usually performed by soldiers. Accordingly, an unmanned robot employing AI technology can efficiently reduce manpower and greatly enhance a military's competitive power.

As can be appreciated from the above, a monitoring and sentry robot can perform an important role in the development of military strategy. Also, the use of robots can prevent or at least minimize fatigue and loss of concentration due to repetition of simple tasks performed by soldiers on sentry duty. Furthermore, the systems can have accurate tracking and instant reaction abilities, including high speed and accurate shooting capabilities.

U.S. Pat. No. 5,379,676 entitled "Fire Control System" discloses a shooting control system for a manually aimed gun. As described in the patent, a target is tracked by a video tracker and laser of an electro-optical device (EOD), and the distance and direction of the target are calculated. The image of target is sent to a video monitor of an operator, and the operator controls shooting at the target by controlling the gun to aim at the target through the use of the video monitor.

However, a drawback of this type of shooting control system is the limited range of monitoring by a camera device of the system. Also, the conventional monitoring and sentry system employing a single video camera or common monitoring camera is a basic system adopting the concept of automation, and not a system capable of intelligently recognizing a target and automatically tracking the target.

Also, in the conventional monitoring and sentry system, switching between a safety mode and a shooting mode is performed by a user. Thus, it would be desirable for the sentry system to employ a driving mechanism that can automatically switch between safety and shooting modes.

SUMMARY OF THE INVENTION

An embodiment of the present invention provides an automatic shooting mechanism that is capable of remote or automatic switching between a safety mode and a shooting mode and capable of remote shooting or unmanned shooting at a target.

Also, an embodiment of the present invention provides a robot having an automatic shooting mechanism, and which is capable of performing monitoring and sentry duties along with wide and narrow monitoring in short and long ranges and can automatically shoot at a target.

An automatic shooting mechanism according to an embodiment of the present invention comprises a safety moving member, such as a safety solenoid, and an elastic member to effect movement of a safety pin of a gun between a safety mode position and a shooting mode position, and a return unit for applying force to the safety pin of the gun to move the safety pin to the safety mode position. The automatic shooting mechanism further comprises a shooting unit including a shooting moving member, such as a shooting solenoid to move a connecting link back and forth, and a trigger push member having one end contacting a trigger of the gun and the other end coupled to the shooting solenoid via the connecting link, and which is coupled at a middle portion to the shooting unit and capable of pivoting.

The elastic member included in the safety unit is arranged to apply force to move the safety pin of the gun to the safety mode position, and the safety solenoid applies force when power is applied to move the safety pin to the shooting mode position.

Another embodiment of the present invention provides a sentry robot comprising a base, a main body installed on the base and capable of pivoting, a master camera capable of rotating with the main body, an automatic shooting mechanism arranged with a gun on the main body, and an active camera capable of rotating with the gun.

The master camera can comprises two cameras, each installed at both sides of the main body.

The sentry robot further comprises a driving portion for driving the main body, the master camera, the active camera, and the gun, and a controller for controlling shooting of the gun and performing functions such as image analysis, target recognition, and target tracking by controlling the driving portion.

BRIEF DESCRIPTION OF THE DRAWINGS

The above and other features and advantages of the present invention will become more apparent by describing in detail embodiments thereof with reference to the attached drawings, in which.

DETAILED DESCRIPTION OF THE INVENTION

Figure 1:
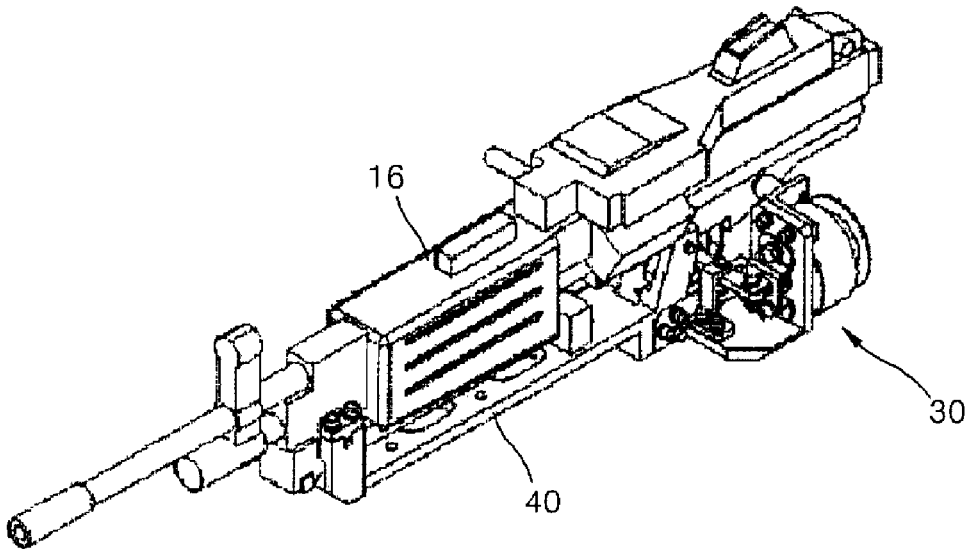
FIG. 1 illustrates an automatic shooting mechanism according to an embodiment of the present invention which is coupled to a gun and a gun mount.
Figure 2:
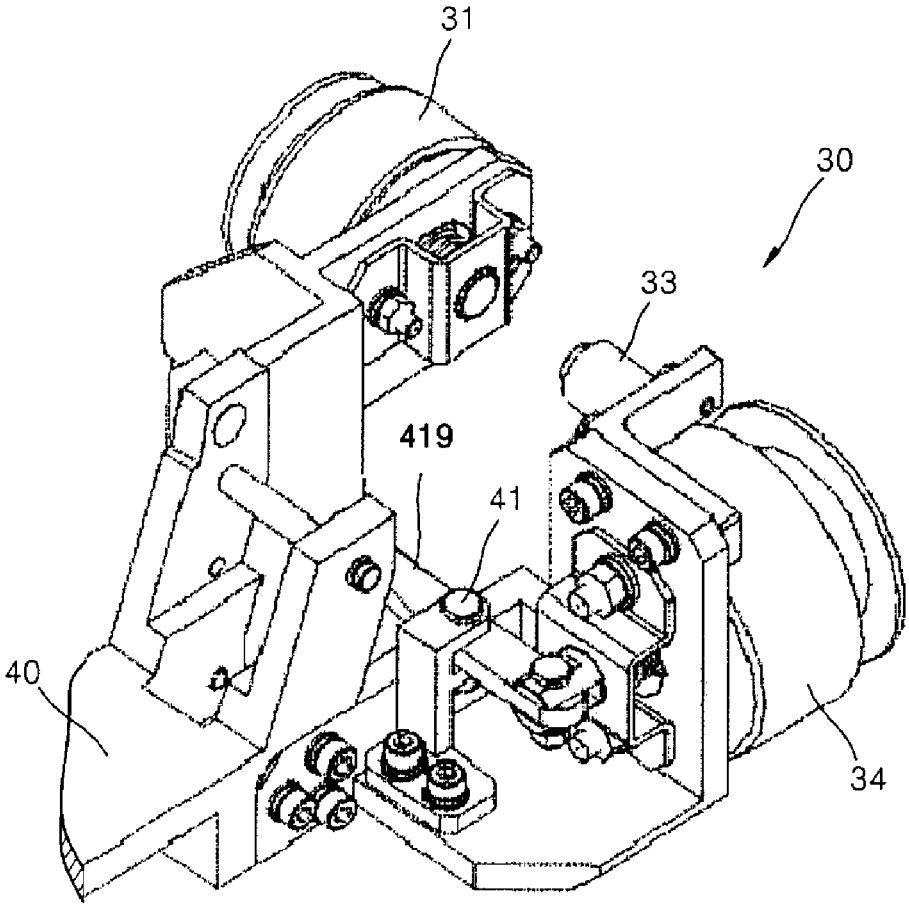
FIG. 2 is an enlarged perspective view of the automatic shooting mechanism of FIG. 1.
Figure 3:
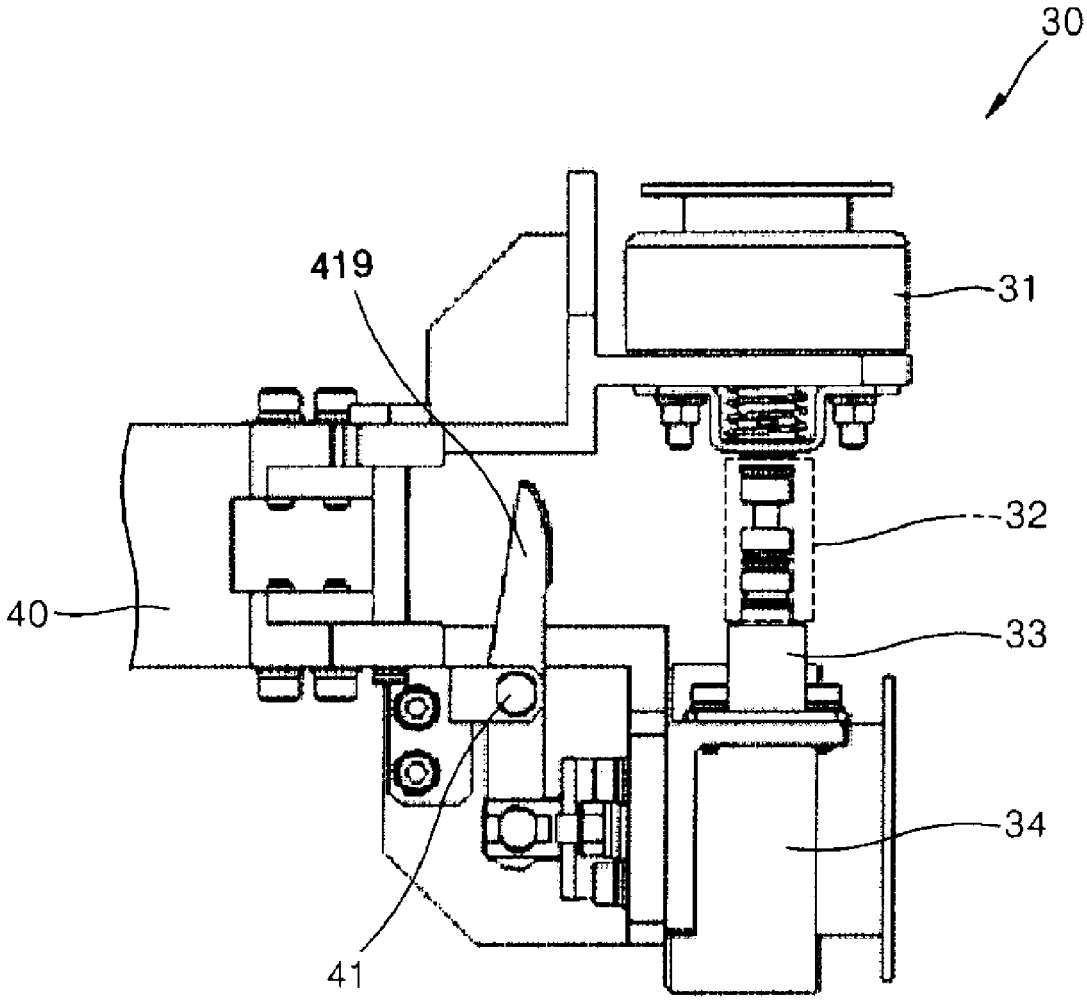
FIG. 3 is a top plan view of the automatic shooting mechanism of FIG. 1.

FIG. 1 illustrates an automatic shooting mechanism according to an embodiment of the present invention which is coupled to a gun and a gun mount. FIG. 2 is an enlarged perspective view of the automatic shooting mechanism of FIG. 1. FIG. 3 is a top plan view of the automatic shooting mechanism of FIG. 1, and FIG. 4 is an exploded perspective view of the automatic shooting mechanism of FIGS. 2 and 3.

As shown in FIG. 1, an automatic shooting mechanism 30 according to an embodiment of the present invention is arranged at the rear of a gun mount 40 where a gun 16 is fixedly mounted. As shown in FIGS. 2 and 3, the automatic shooting mechanism 30 includes a safety unit 31, a return unit 33, and a shooting unit 34. A safety pin 32 as shown in FIG. 3 is included in the gun 16 and the gun 16 is placed in a safety mode or a shooting mode depending on the position of the safety pin 32.

Figure 4:
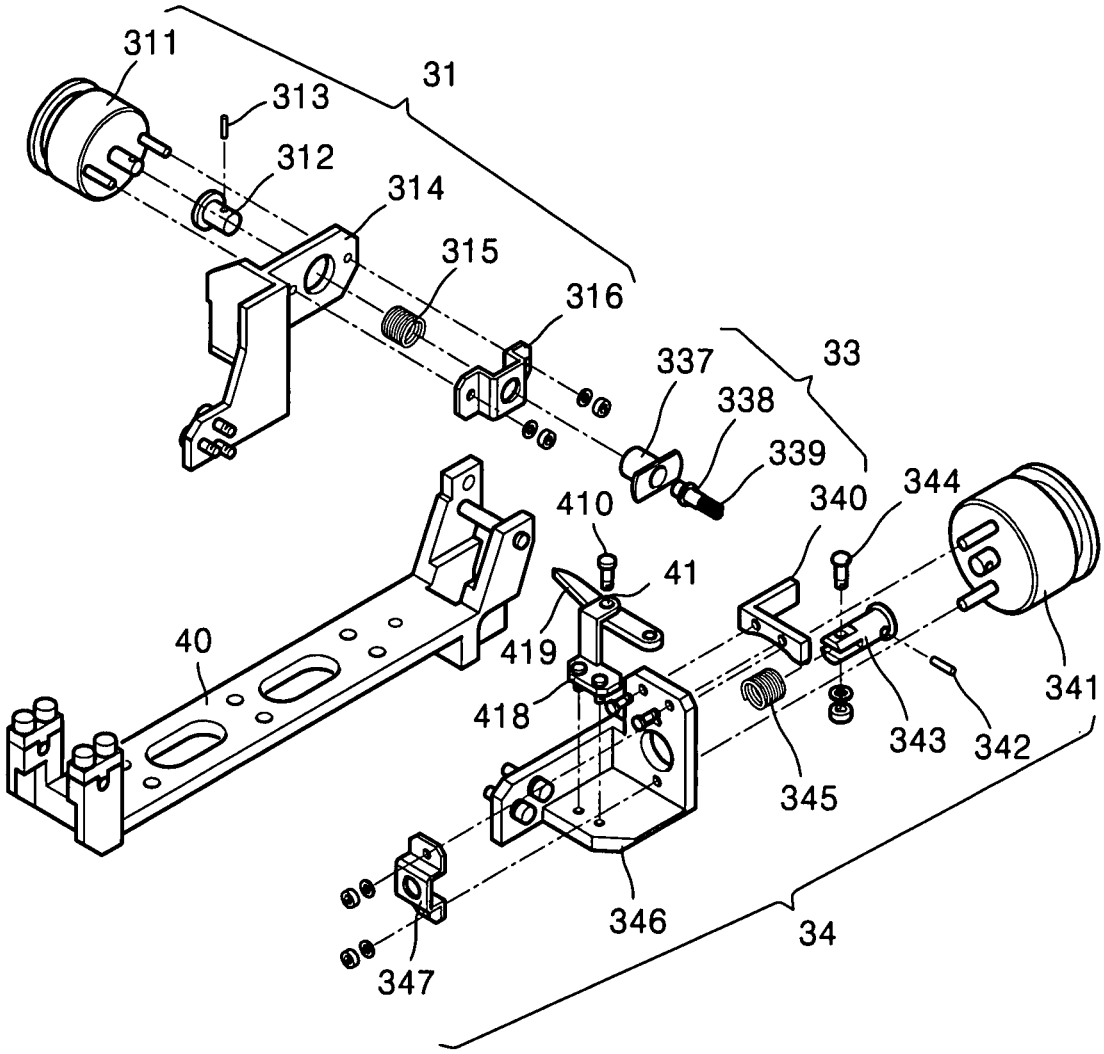
FIG. 4 is an exploded perspective view of the automatic shooting mechanism of FIGS. 2 and 3.

Referring to FIG. 4, the safety unit 31 included in the automatic shooting mechanism in this example is formed by sequentially assembling the safety moving member, such as a solenoid 311 (safety solenoid 311), and a safety rod 312, along with a bracket 314, an elastic member 315, a spring pin 313, and a cover plate 316. In this case, the bracket 314 is fixed to the gun mount 40 and the safety rod 312 is fixed by the spring pin 313 in the safety solenoid 311. The elastic member 315 and the safety rod 312 are inserted together in an opening formed in the bracket 314. The cover plate 316 and the safety solenoid 311 are fixedly assembled at the bracket 314.

As can be appreciated from FIG. 4, the safety solenoid 311 is capable of moving a safety rod 312 having a predetermined length back and forth under the influence of applied power and thus, the safety solenoid 311 in cooperation with the elastic member 315 moves the safety pin 32 between the safety mode position and the shooting mode position. For example, the elastic member 315 applies force to the safety pin 32 to move the safety pin 32 toward the safety mode position. When power is applied, the safety solenoid 311 applies force to the safety pin 32 to move the safety pin 32 toward the shooting mode position. When the power applied to the safety solenoid 311 is discontinued, the safety pin 32 is allowed to return to the safety mode position because the elastic member 315 moves the safety rod in the direction of the safety mode position.

The return unit 33 in this example includes an elastic member body 337, a push pin 338, and an elastic member 339 for applying force to the safety pin 32 of the gun 16 in the same direction as the direction in which the elastic member 315 moves. Since the elastic member 339 of the return unit 33 applies the force in the same direction as the direction in which the safety pin 32 is in the safety mode position, the safety pin 32 can quickly return to the safety mode position when shooting is not needed.

The shooting unit 34 in this example includes a shooting moving member, such as a solenoid 341 (shooting solenoid 341), a spring pin 342, a connecting link 343, an elastic member 345, a bracket 346, a cover plate 347, a front support 418, and a trigger push member 419. In this example, the shooting solenoid 341 is fixed at the connecting link 343 by the spring pin 342, inserted with the elastic member 345 in an opening formed in the bracket 346, and fixed at the bracket 346 by the cover plate 347. The trigger push member 419 is fixed at the bracket 346 by the front support 418 capable of rotating around the pivot position 41. The bracket 346 can be fixed at the gun mount 40 where the gun 16 is mounted. The return unit 33 can be coupled to the bracket 346 included in the shooting unit 34 via a support 340 such that the push pin 338 is inserted in the elastic member body 337 and the elastic member 339 is coupled to an end portion of the push pin 338: The elastic member 339 is maintained in a state in which force is applied to the safety pin 32 to place the safety pin 32 in the safety mode position.

The trigger push member 419 is arranged such that one end thereof is connected to the shooting solenoid 341 and the other end thereof contacts a trigger (not shown) of the gun 16. The middle portion of the trigger push member 419 is rotatably connected to a front support 418 by a pin joint 410 at a predetermined pivot position 41. The shooting solenoid 341 can move a connecting link 343 having a predetermined length back and forth under the influence of power. The shooting solenoid 341 thus pushes one end of the trigger push member 419 so that trigger push member 419 pushes the trigger and fires the gun 16.

When the safety unit 31 switches from the safety mode to the shooting mode, power is applied to the shooting solenoid 341 by a user or a predetermined control mechanism as necessary. Then, the shooting solenoid 341 pushes one side of the trigger push member 419 and the trigger push member 419 pushes the trigger. When the power applied to the shooting solenoid 341 is discontinued, the elastic member 345 returns the shooting solenoid 341 and the trigger push member 419 to their original positions. Continuous or rapid fire shooting is possible by controlling the power applied to the shooting solenoid 341.

The automatic shooting mechanism according to the above-described embodiment with reference to FIGS. 1 through 4 can be used with a sentry robot which is described below.

Figure 5:
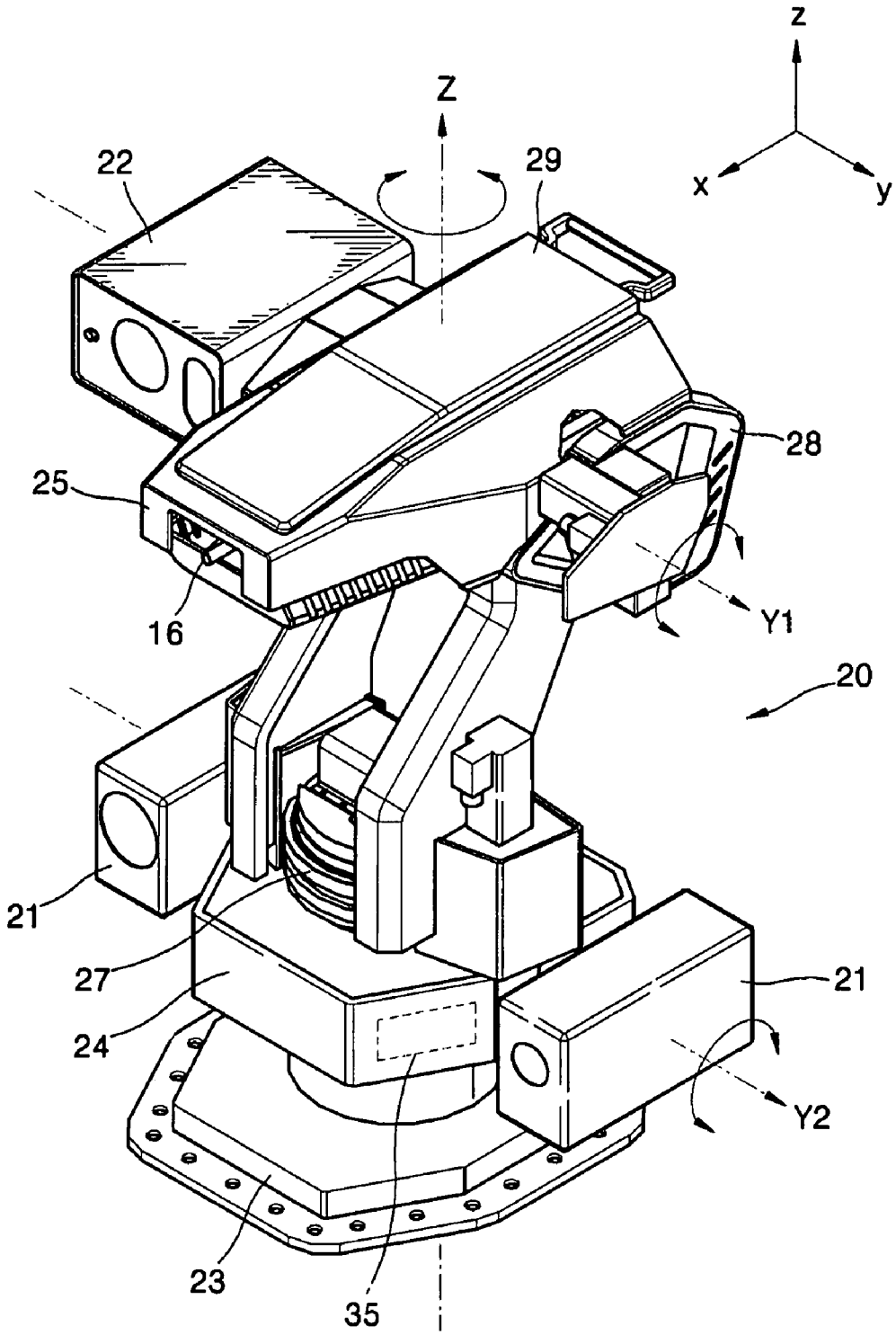
FIG. 5 is a perspective view showing the structure of a sentry robot according to an embodiment of the present invention.
Figure 6:
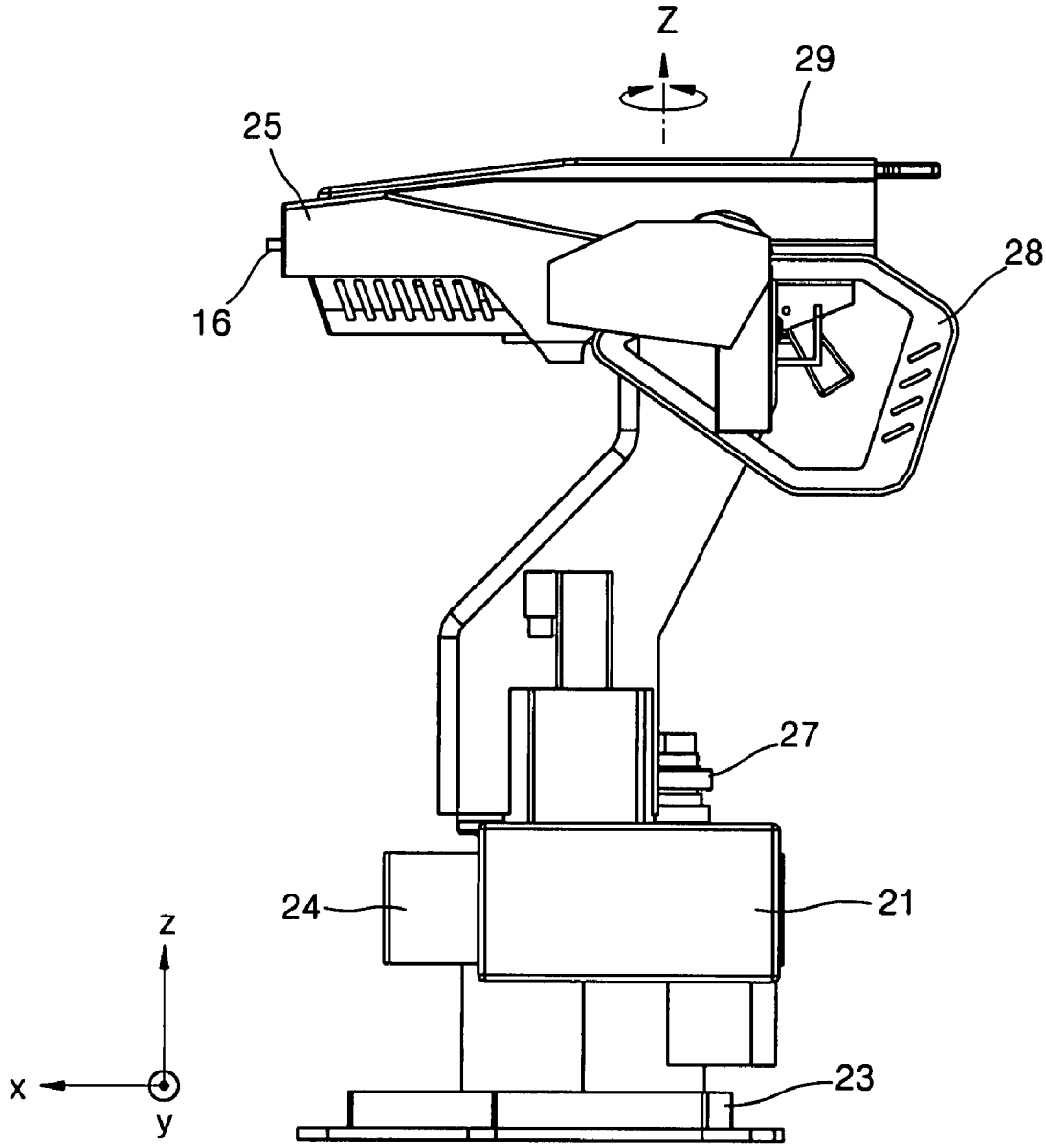
FIG. 6 is a side view of the sentry robot of FIG. 5.

FIG. 5 is a perspective view showing an example of the structure of a sentry robot according to an embodiment of the present invention. FIG. 6 is a side view of the sentry robot of FIG. 5. Referring to FIGS. 5 and 6, a sentry robot 20 according to an embodiment of the present invention includes a base 23, an image monitoring portion, and an image tracking portion.

The base 23 is a member for fixedly installing the sentry robot 20 at a particular position or device. The image monitoring portion includes a main body 24 arranged on the base 23, a master camera 21 and an image monitoring portion driving portion 27 which is described in detail below. The image tracking portion in this example includes an active camera 22 arranged on the main body 24, the gun 16, and an image tracking portion driving portion 27.

The sentry robot 20 in this example includes two types of cameras, that is, the master camera 21 and an active camera 22. The sentry robot 20 receives information on the movement of a target from each of the cameras 21 and 22 and performs tracking for monitoring and sentry operations so that a tracking rate and a recognition rate are improved.

The main body 24 is capable of rotating on the base 23 to the left and right sides (panning) around a Z axis. The mast camera 21 and the active camera 22 are installed on the main body 24. The gun 16 is installed with the active camera 22, as necessary. Gun armor 25 to protect the robot from bullets or debris is, installed outside the main body 24 in this example.

The gun armor 25 can include a gun cover 29 which can be open and close by an operator to check the state of the gun 16. Also, a gun manual control handle 28 can be further installed to, directly control the gun 16 by the operator as necessary.

The master camera 21 is installed on the main body 24, or at both sides of the main body 24 as shown in the drawings, and recognizes a target from an input image. The master camera 21 is rotatable around a Y2 axis in a vertical direction with respect to the main body 24. The active camera 22 is provided on the main body 24 and is capable of tilting and panning with respect to the main body 24 and tracking the target.

The gun 16 that capable of shooting bullets or other projectiles or objects automatically or manually toward a target or an enemy is arranged in the upper portion of the main body 24. Also, the image tracking portion driving portion 27 which allows the active camera 22 and the gun 16 to move while tracking the target is installed in the upper portion of the main body 24.

The image tracking portion driving portion 27 can rotate the active camera 22 and the gun 16 to the left and right sides around the Z axis and simultaneously up and down around a Y1 axis with respect to the main body 24. The automatic shooting mechanism configured as shown in FIGS. 1 through 4 is installed at the gun 16 to perform maintenance of the gun 16 in a shooting mode or a safety mode, and automatic shooting control in the shooting mode.

The sentry robot 20 according to an present embodiment may, further include a controller 35 that can be installed inside the main body 24 as shown and can be a processor, computer or any other suitable type of device. The controller 35 receives an image from the master camera 21 and the active camera, 22, recognizes the received image, and controls the operation of the master camera 21, the active camera 22, and the image tracking portion driving portion 27.

Considering that a target has a certain size, an not simply a point, it is preferable that a gun barrel of the gun 16 is parallel or substantially parallel to the optical axis of the active camera 22 so that the direction of the gun barrel of the gun 16 pointing toward a target matches the direction of the active camera 22. The master camera 21 and the active camera 22 in this example are ultra-low brightness cameras having an infrared block filter blocking input of an image in an infrared area. The master camera 21 and the active camera 22 can receive a color image by turning on the infrared block filter during the day or in sufficiently lit environments, and a black and white image by turning off the infrared block filter during the night or in low lighting environments. Accordingly, the master camera 21 and the active camera 22 can receive an image during the day and night, and in well lit and dark environments, using the ultra-low brightness camera.

The, master camera 21 preferably has a wider viewing angle than the active camera 22. That is, the master camera 21 with a wider viewing angle performs a function of detecting an overall movement in a main viewing range. The master camera 21 has a zoom function and is set by adjusting a magnification ratio according to conditions in use such as observation distance and range. The master camera 21 recognizes a target by acquiring an image from a wide area in the main viewing range and detects an overall movement of the target.

The active camera 22 is controlled by the controller 35, for example, to move according to information pertaining to the movement of a target recognized by the master camera 21 so that the optical axis of the active camera 22 is directed toward the center of the target. Also, the active camera 22 more accurately detects information such as the speed, displacement, and size of a target that moves, and maintains a higher resolution as compared to the master camera 21. For this purpose, the active camera 22 has functions of zooming, panning, and tilting. The panning and tilting functions of the active camera 22 enable the optical axis of the active camera 22 to always point to the center, or proximate to the center, of the target. Also, the image of the target can be enlarged by the zooming function of the active camera 22 so that the target can be observed in more detail. Accordingly, given that the target has a certain size, since the direction of the gun barrel of the gun 16 fixedly installed with respect to the active camera 22 substantially matches the center axis of the active camera 22 pointing the target, the gun barrel of the gun 16 can point the target.

Figure 7:
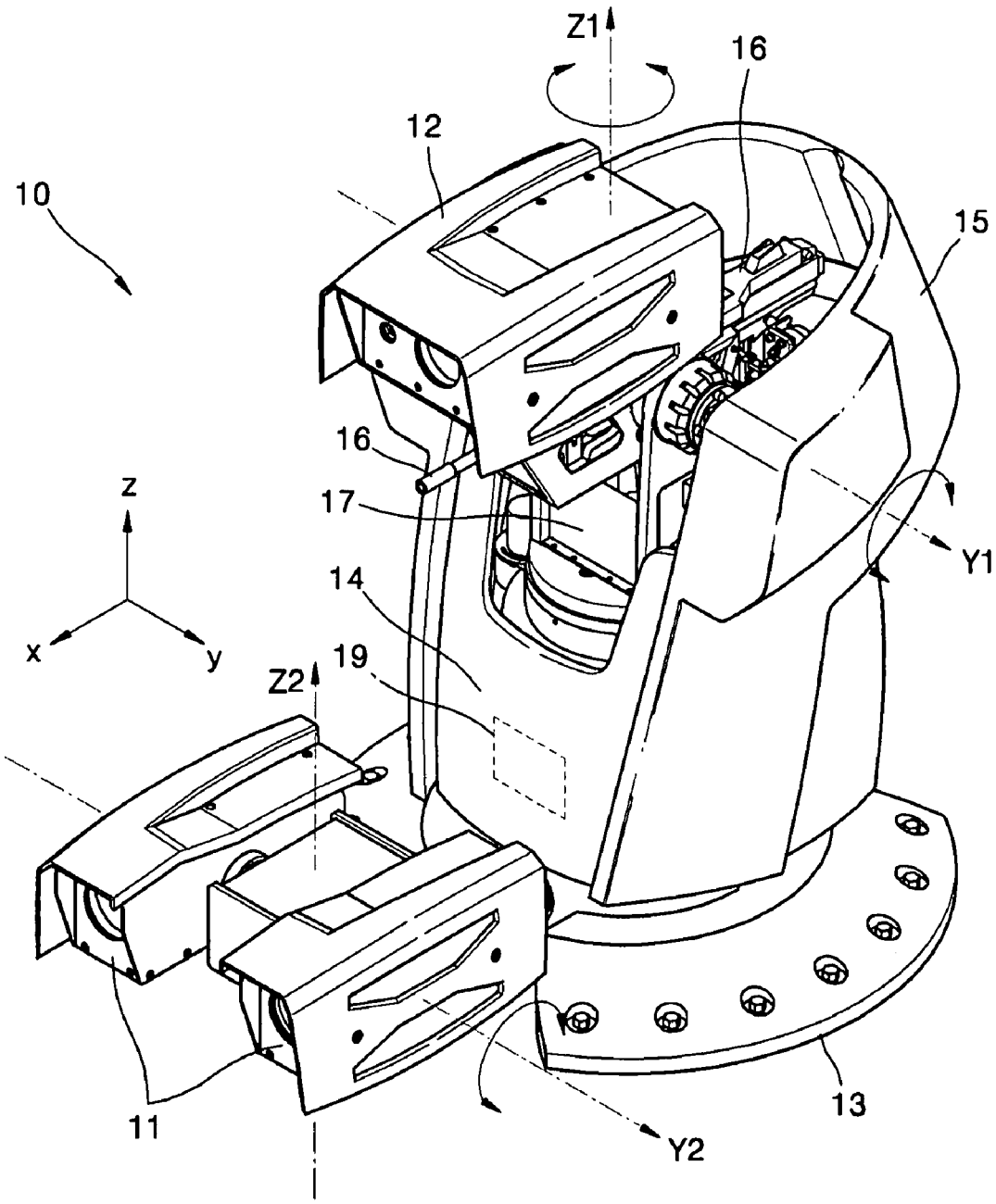
FIG. 7 is a perspective view showing the structure of a sentry robot according to another embodiment of the present invention.
Figure 8:
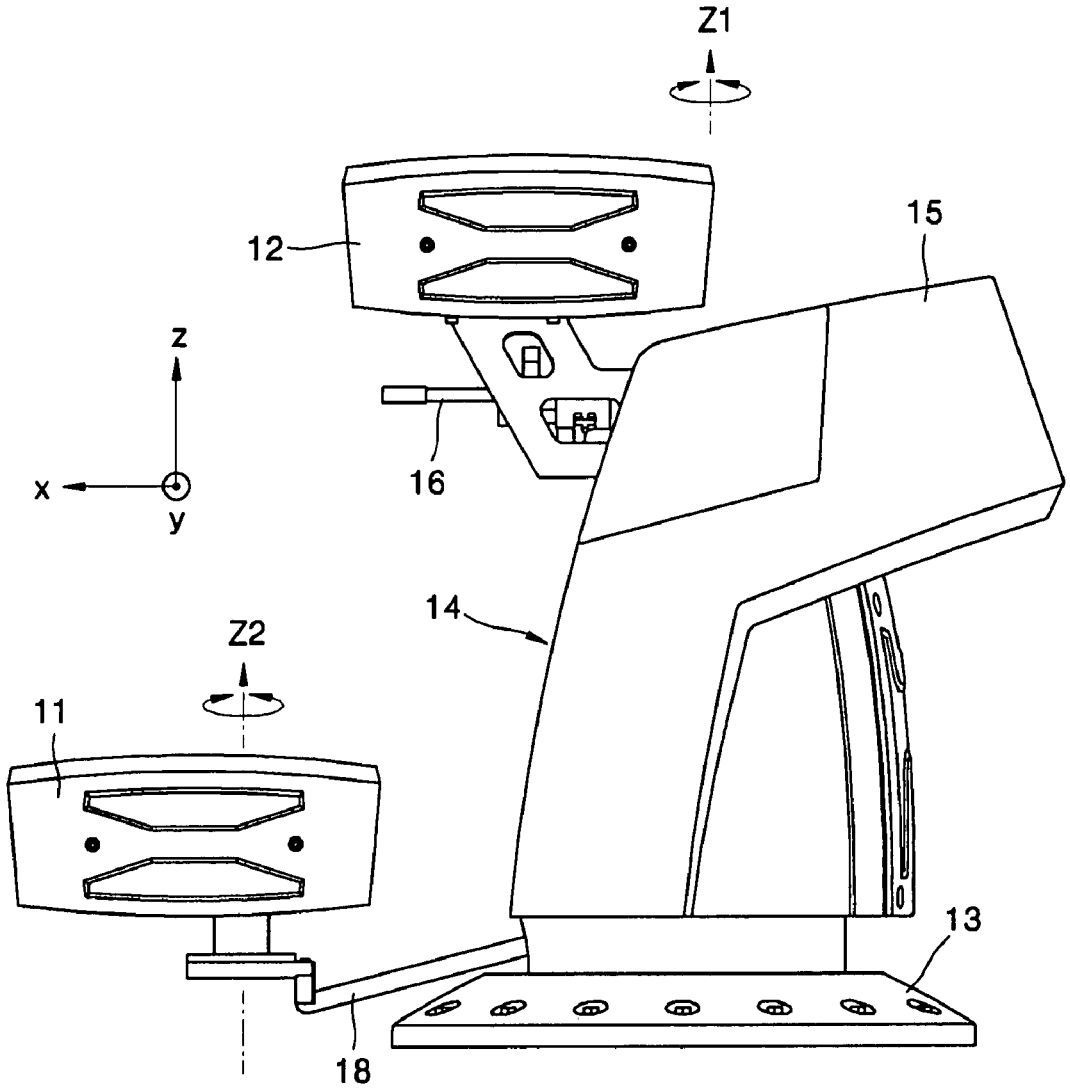
FIG. 8 is a side view of the sentry robot of FIG. 7.

FIG. 7 is a perspective view schematically showing the structure of a sentry robot according to another embodiment of the present invention, and FIG. 8 is a side view of the sentry robot of FIG. 7. Referring to FIGS. 7 and 8, a sentry robot 10 according to another embodiment of the present invention includes a base 13, a main body 14, a master camera 11, and an active camera 12. The sentry robot 10 is operated by two types of cameras, that is, the master camera 11 and the active camera 12. The sentry robot 10 receives information on the movement of a target from each of the cameras and performs monitoring and tracking for sentry so that a tracking rate and a recognition rate are improved. It is a difference from the above-described embodiment that the master camera 11 is arranged to protrude forward from the main body 14.

The sentry robot 10 may further include a controller 19 that is similar to controller 35 discussed and can be located inside the main body 14. The controller 19 receives an image from the master camera. 11 and the active camera 12, recognizes the received image, and controls the operations of the master camera 11, the active camera 12, and a driving portion 17.

The master camera 11 is connected to the main body 14 by a frame 18 and recognizes a target from an input image. The main body 14 is rotatable on the base 13 to the left and right directions around a Z1 axis. Accordingly, the frame 18 and the master camera 11 can pivot in the left and right directions around the Z1 axis. Also, the master camera 11 is installed capable of rotating in the left and right directions around a Z2 axis and in the up and down directions around a Y2 axis with respect to the frame 18.

The active camera 12 is capable of rotating in the left and right directions around a Z1 axis and in the up and down directions around a Y1 axis with respect to the main body 14. The active camera 12 can be installed with a gun 16 as shown in FIGS. 7 and 8. In this case, the active camera 12 and the gun 16 are arranged to have the same pointing directions so that they are capable of rotating in the up/down and left/right directions on the main body 14 while tracking a target.

Armor 15 in this example is installed on the outer side of the main body 14 to protect the robot 10 from enemy's bullets or debris. The automatic shooting mechanism as shown in FIGS. 1 through 4 is installed at the gun 16 to control the shooting of the gun 16 as discussed above.

As described above, the automatic shooting mechanism according to an embodiment of the present invention can shoot under the control of a user at a remote location. A warning shot can be fired, or directional shooting is possible at an enemy target according to a predetermined control algorithm. Also, the sentry robot according to an embodiment of the present invention can accurately move the gun or camera to point toward a target while also tracking the target. The target moving at short and long distances can be effectively tracked, automatic shooting at the target is possible, and in particular, unmanned sentry duties can be performed for a wider area as compared to a conventional sentry robot.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An automatic shooting mechanism comprising:

a holding region that holds a gun having a safety mechanism and trigger, the holding region having a trigger contacting region and a separate safety mechanism contacting region;

a mechanical safety unit including an electronically actuated safety moving member and an elastic member in the safety mechanism contacting region to effect movement of the safety mechanism of the gun between a safety mode position and a shooting mode position, the mechanical safety unit being external to the gun;

a mechanical return unit, external to the gun, for applying force to the safety mechanism to move the safety mechanism to the safety mode position; and a mechanical shooting unit, external to the gun and including an electronically actuated shooting moving member in the trigger contacting region to effect movement of a trigger push member having one end for contacting and moving the trigger of the gun.

2. The automatic shooting mechanism of claim 1, wherein the elastic member is arranged to apply force in a direction that enables the safety mechanism to move toward the safety mode position, and the safety moving member operates to apply force to move the safety mechanism to the shooting mode position.

3. The automatic shooting mechanism of claim 1, wherein the safety moving member includes a solenoid and the shooting moving member includes another solenoid.

4. The automatic shooting mechanism of claim 1, wherein the mechanical safety unit further comprises a rod that is moveable by the safety moving member to contact and move the safety mechanism to the shooting mode position.

5. The automatic shooting mechanism of claim 1, wherein the mechanical return unit includes an elastic member for applying the force to the safety mechanism to move the safety mechanism to the safety mode position.

6. The automatic shooting mechanism of claim 5, wherein the mechanical return unit further includes a pin for movement by the elastic member to contact and apply the force to the safety mechanism.

7. The automatic shooting mechanism of claim 1, wherein the force applied to the safety mechanism by the mechanical return unit moves the safety mechanism to the safety mode position when the safety moving member operates to effect movement of the safety mechanism to the safety mode position.

8. The automatic shooting mechanism of claim 1, wherein the mechanical shooting unit further includes a connecting link that couples the shooting moving member to the trigger push member to enable the shooting moving member to move the trigger push member.

9. The automatic shooting mechanism of claim 1, wherein the mechanical shooting unit further includes an elastic member that applies a force to the trigger push member to influence movement of the one end of the trigger push member away from the trigger.

10. The automatic shooting mechanism of claim 9, wherein the force applied by the elastic member influences movement of the one end of the trigger push member away from the trigger when the shooting moving member moves the trigger push member to move the one end of the trigger push member away from the trigger.

11. The automatic shooting mechanism of claim 1, wherein the trigger push member is pivotably coupled to the shooting unit to pivot toward and away from the trigger.

12. The automatic shooting mechanism of claim 1, further comprising a computerized controller that controls operation of the mechanical safety unit, the mechanical return unit and the mechanical shooting unit.

13. The automatic shooting mechanism of claim 1, further comprising a robot which houses the mechanical safety unit, the mechanical return unit and the mechanical shooting unit.

14. The automatic shooting mechanism of claim 13, wherein the robot further comprises a pivotable main body, with the mechanical safety unit, the mechanical return unit and the mechanical shooting unit being coupled to the main body.

15. The automatic shooting mechanism of claim 14, further comprising:

a master camera arranged to rotate with the main body; and an active camera arranged to rotate with the gun.

16. The automatic shooting mechanism of claim 15, wherein the master camera comprises two cameras, each installed at both sides of the main body.

17. The automatic shooting mechanism of claim 15, further comprising:

a driving portion for driving the main body, the master camera, the active camera, and the gun; and a controller for controlling shooting of the gun and for performing at least one of image analysis, target recognition, and target tracking.

18. The automatic shooting mechanism of claim 14, further comprising:

a base, configured such that the main body is coupled to the base and is pivotable with respect to the base.

19. The automatic shooting mechanism of claim 3, wherein the safety moving member solenoid and the shooting moving member solenoid have actuators that move at right angles to one another.

20. The automatic shooting mechanism of claim 1, wherein the holding region surrounds a portion of the gun on at least three sides.

21. The automatic shooting mechanism of claim 1, wherein the electronically actuated safety moving member and the electronically actuated shooting moving member are located proximally adjacent to the gun safety mechanism and trigger respectively.

* * * * *